US011230783B2

(12) United States Patent
Abbott et al.

(10) Patent No.: US 11,230,783 B2
(45) Date of Patent: Jan. 25, 2022

(54) METHOD AND SYSTEM FOR ELECTROPLATING A MEMS DEVICE

(71) Applicant: Texas Instruments Incorporated, Dallas, TX (US)

(72) Inventors: Donald Charles Abbott, Chartley, MA (US); Kathryn Ann Schuck, Dallas, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 46 days.

(21) Appl. No.: 16/889,513

(22) Filed: Jun. 1, 2020

(65) Prior Publication Data

US 2020/0291539 A1 Sep. 17, 2020

Related U.S. Application Data

(62) Division of application No. 15/383,994, filed on Dec. 19, 2016, now Pat. No. 10,704,156.

(60) Provisional application No. 62/268,654, filed on Dec. 17, 2015.

(51) Int. Cl.

| | |
|---|---|
| ***C25D 17/00*** | (2006.01) |
| ***C25D 17/12*** | (2006.01) |
| ***C25D 17/10*** | (2006.01) |
| ***C25D 7/12*** | (2006.01) |
| *C25D 3/38* | (2006.01) |
| *C25D 3/48* | (2006.01) |
| *C25D 3/54* | (2006.01) |

(52) U.S. Cl.
CPC ..... *C25D 7/12* (2013.01); *C25D 17/001* (2013.01); *C25D 17/10* (2013.01); *C25D 17/12* (2013.01); *C25D 3/38* (2013.01); *C25D 3/54* (2013.01)

(58) Field of Classification Search
CPC ..... C25D 7/12–123; C25D 17/001
See application file for complete search history.

(56) References Cited

U.S. PATENT DOCUMENTS

| | | | | |
|---|---|---|---|---|
| 4,102,770 | A | 7/1978 | Moriarty et al. | |
| 4,384,926 | A * | 5/1983 | Wagner | C25D 5/02 204/224 R |
| 4,793,902 | A | 12/1988 | Furuya et al. | |
| 6,383,352 | B1 * | 5/2002 | Shyu | C25D 7/12 204/280 |
| 6,709,564 | B1 | 3/2004 | Tench et al. | |
| 2002/0053510 | A1 | 5/2002 | Woodruff et al. | |
| 2003/0062258 | A1 * | 4/2003 | Woodruff | C25D 7/123 204/272 |
| 2004/0026255 | A1 * | 2/2004 | Kovarsky | C25D 21/18 205/99 |
| 2018/0016688 | A1 * | 1/2018 | Angelini | C25D 17/12 |

* cited by examiner

*Primary Examiner* — Ho-Sung Chung
(74) *Attorney, Agent, or Firm* — Michelle F. Murray; Charles A. Brill; Frank D. Cimino

(57) ABSTRACT

In described examples, a method for electroplating a semiconductor device includes: forming a metal foil; forming an inert anode support; attaching the metal foil to the inert anode support to form an anode; forming a cathode using a semiconductor substrate; immersing the anode and the cathode within an electrolyte solution; forming a circuit with a current source, the anode and the cathode; generating a current through the circuit; and electroplating a metal from the electrolyte solution onto the semiconductor substrate.

12 Claims, 2 Drawing Sheets

METHOD AND SYSTEM FOR ELECTROPLATING A MEMS DEVICE

CROSS-REFERENCE TO RELATED APPLICATION

This application is a divisional application of U.S. Non-Provisional application Ser. No. 15/383,994 filed Dec. 19, 2016, which also claims the benefit of U.S. Provisional Patent Application Ser. No. 62/268,654, filed Dec. 17, 2015, which applications are hereby fully incorporated herein by reference in their entireties.

TECHNICAL FIELD

This relates generally to semiconductor devices, and more particularly to microelectromechanical systems ("MEMS").

BACKGROUND

Semiconductors often include integrated devices fabricated using a substrate or wafer. Examples of typical materials include silicon and gallium arsenide. Semiconductor devices integrate various circuit elements, such as resistors, capacitors, transistors, inductors, insulators and different types of memory.

MEMS devices integrate small mechanical systems with semiconductors to form various devices, such as sensors (e.g., temperature, pressure, gas, moisture and motion sensors), accelerometers, valves, motors, actuators and micromirrors.

Electroplating is one method used in fabrication of electrical contact points for MEMS devices and in MEMS packaging. Electroplating may include selective or blanket deposition of metals. Compared to other coating methods, electroplating can accommodate a variety of process temperatures and deposition rates. Electroplating can also yield varied deposit morphologies to accommodate specific applications.

FIG. 1 (prior art) is an illustration of a typical semiconductor electroplating apparatus 100, which includes a vessel 102 with a reservoir containing an electrolyte solution 104, an anode 106 and a cathode 108. The cathode 108 and the anode 106 form an electrical circuit with the electrolyte solution 104 and a power supply 112.

The cathode 108 typically includes the semiconductor wafer to be metallized. The cathode 108 is held to a support 110 by a clamp. For precious metal electroplating, such as gold plating, the anode 106 is formed from a metal (such as titanium) that is coated with platinum.

The electrolyte solution 104 is selected according to the metal to be electroplated. In at least one example, the electrolyte solution 104 includes: a solution of copper sulfate for copper plating; or a different solution of sodium or potassium gold cyanide for gold plating.

Electroplating can be performed using either: inert anodes, such as titanium with a thin coating of platinum (platinized titanium); or soluble anodes. If electroplating using inert anodes, all of the deposited metal comes from the electrolyte solution. If electroplating using soluble anodes, the deposited metal comes from electrodissolution into the electrolyte solution of the metal being deposited from solid anodes of the same metal. Ideally, the mass of metal dissolved from the soluble anode exactly balances the amount of metal deposited. In one method, the soluble anodes are in contact with an inert supporting anode to facilitate electrical connection and replenishment of the soluble anodes as they are consumed.

In a system with a supporting inert anode (such as platinized titanium) and soluble anodes, such as for indium plating, slow consumption of the platinum coating may occur to expose the underlying titanium substrate to the indium sulfite electrolyte solution 104, and the electrolyte solution 104 pH increases over time. The increase in pH destabilizes the electrolyte solution 104. As the pH of the electrolyte solution 104 increases, an associated increase occurs in indium concentration, due to chemical and galvanic dissolution of indium ions from the solid indium shot soluble anode. These indium ions exceed the complexing capacity of the electrolyte solution. The excess uncomplexed ions then precipitate as $In(OH)_3$, which forms a sludge within the electrolyte solution. Precipitation of $In(OH)_3$ leads to instability of the electrolyte solution and variations in the deposit morphology. During the electroplating process, the cathode 108 or wafer is lowered into the reservoir and brought into contact with the electrolyte solution 104, and a direct electrical current (applied at a specific amperage or voltage) is applied using the power supply 112, which can be either a rectifier or a battery.

FIG. 2 (prior art) is a drawing of an anode 200, which is an inert metal, such as titanium or platinized titanium, approximately circular with a central opening 206. Multiple smaller openings 208 are disposed within the anode 200 to provide a path for fluid flow. The anode 200 may include one or more attachment points 210 to allow connection of the anode 200 to an external power source in the apparatus 100.

If a platinum metal coating 204 is consumed during the electroplating process, then the platinized titanium anode 200 may require periodic replacement. Consumption of the coating 204 exposes an underlying titanium substrate 202 to the electroplating solution 104. The electrolyte solution 104 includes a solution of metal ions to be electroplated. The metal ions are introduced through dissolution of the soluble anodes or chemical addition of metal salts.

In the electroplating process, the anode 200 is placed within the electrolyte solution 104 in the apparatus 100. The electrolyte solution 104 is agitated, stirred or circulated to provide an even distribution of metal ions from within the electrolyte solution 104 across surfaces and edges of the anode 200 and wafer to be electroplated.

In arrangement of FIG. 2, the anode 200 maintains its dimensional integrity, and wafers are electroplated with a uniform thickness of metal.

Small inherent cracks and pores within the platinum metal coating 204 further increase the area to which the electrolyte solution 104 can contact with the titanium substrate 202. The titanium forms a galvanic cell with the indium pellets in solution.

SUMMARY

In described examples, a method for electroplating a semiconductor device includes: forming a metal foil; forming an inert anode support; attaching the metal foil to the inert anode support to form an anode; forming a cathode using a semiconductor substrate; immersing the anode and the cathode within an electrolyte solution; forming a circuit with a current source, the anode and the cathode; generating a current through the circuit; and electroplating a metal from the electrolyte solution onto the semiconductor substrate.

DETAILED DESCRIPTION OF EXAMPLE EMBODIMENTS

Figure 3:
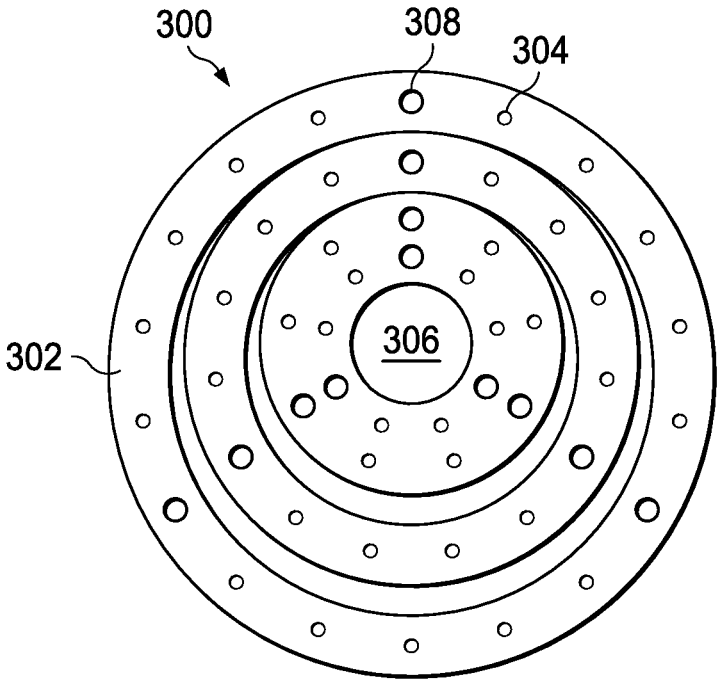
FIG. 3 is an illustration of a plastic or PVC type anode, according to example embodiments.

FIG. 3 shows an anode support 300, according to example embodiments. The anode support 300 is formed in an approximately circular shape. The anode support 300 includes multiple rings 302 in an eccentric pattern and/or a concentric pattern. Openings 304 are disposed within the anode support 300. An opening 306 is centrally located within an innermost one of the multiple rings 302. Attachments 308 provide a means for attaching the anode support 300 onto an anode metal foil.

Figure 1:
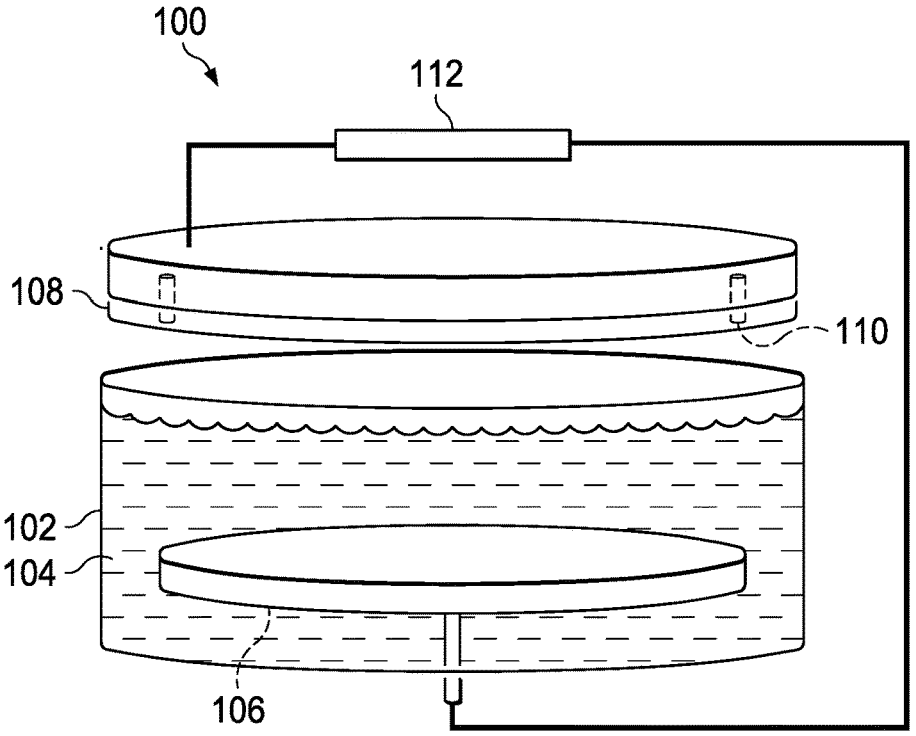
FIG. 1 (PRIOR ART)
FIG. 1 (prior art) is an illustration of a semiconductor electroplating apparatus.
Figure 2:
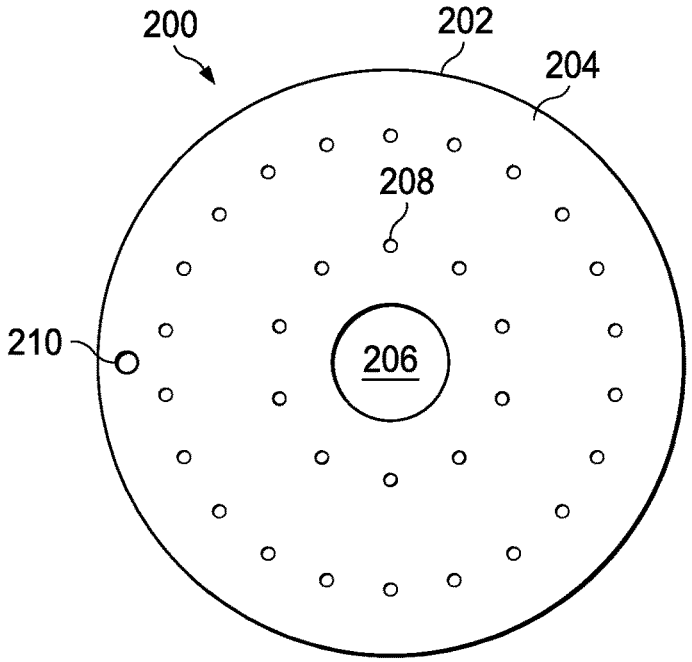
FIG. 2 (PRIOR ART)
FIG. 2 (prior art) is a drawing of an anode.

In an example embodiment, the titanium anode support 200 (FIG. 2) coated with platinum is replaced by the anode support 300, which is formed of an inert material such as polyvinyl chloride (PVC) or plastic. A metal foil (or, alternatively, a wire or a mesh), such as platinum or zirconium, is attached onto the PVC or plastic support 300 to form an anode. The anode (including the inert support 300 and metal foil) is placed within the electrolyte solution 104 during the electroplating process.

In at least one example, the metal foil has a shape and size similar to the inert support 300. The metal foil is attached to the inert support 300 before the electroplating process. The inert support 300 provides a corrosion resistant and chemically inert support for the metal foil. The inert support 300 is not degraded during the electroplating process. In an example embodiment, the metal foil's thickness is less than 500 microns.

Accordingly, in described examples, the anode and a cathode are immersed in an electrolyte solution. The cathode includes a semiconductor substrate. The anode includes at least one of the following attached to an inert support 300 of a similar shape and size: a metal foil; a wire; and a mesh. The metal foil (or, alternatively, the wire or the mesh) may be formed using a metal, such as platinum or zirconium. The support 300 may include a plastic or polyvinyl chloride (PVC) or plastic. The metal foil (or, alternatively, the wire or the mesh) and inert support 300 include numerous openings 304 within both materials to allow liquid flow. The metal foil is not consumed, and the electrolyte solution does not damage the inert support 300.

In the example method, an anode and a cathode are immersed in an electrolyte solution. The cathode includes a semiconductor substrate. The anode includes a metal foil, a mesh or a wire attached to a plastic support of a similar shape and size as the metal anode it replaces. The metal foil, mesh or wire is formed using an inert metal, such as platinum or zirconium. The metal foil and the inert support 300 do not corrode, and neither the metal foil (or, alternatively, the wire or the mesh) nor the inert support 300 are damaged by the electrolyte solution.

The anode (formed by the inert support 300 supporting the metal foil) obtains a consistent and uniform layer of metal on the cathode. The electroplating process does not require ongoing adjustment for corrosion and maintenance using the anode formed of the inert support 300 and a metal foil. By using the inert support 300 with a metal foil, foils of alternate metals (such as titanium, zirconium, and palladium) for electroplating are more readily evaluated. Indium or other ions in the indium sulfite electrolyte solution do not precipitate with the use of metal foil supported by the inert support 300. Also, anode lifetime is increased by orders of magnitude (from weeks to years of use) with an anode formed of the inert support 300 supporting the metal foil. Moreover, changes in placement of the openings 304 in the inert support 300 and metal foil may be easily made, allowing alterations in flow patterns of the electrolyte solution through the anode.

Modifications are possible in the described embodiments, and other embodiments are possible, within the scope of the claims.

What is claimed is:

1. A system, comprising:

an anode comprising an inert anode support and a metal foil attached to the inert anode support, wherein the inert anode support comprises multiple rings in an eccentric pattern;

an electrolyte solution around the anode; and a circuit connected to the anode.

2. The system of claim 1, wherein the inert anode support comprises plastic.

3. The system of claim 1, wherein the inert anode support comprises polyvinyl chloride (PVC).

4. The system of claim 1, wherein the metal foil is inert to the electrolyte solution.

5. The system of claim 4, wherein a thickness of the metal foil is less than 500 microns.

6. The system of claim 5, wherein the thickness of the metal foil is less than 150 microns.

7. The system of claim 4, wherein the metal foil is a platinum foil.

8. The system of claim 4, wherein the metal foil is a zirconium foil.

9. The system of claim 1, wherein the multiple rings comprise a first ring and a second ring, wherein the first ring encircles the second ring.

10. The system of claim 1, wherein the multiple rings comprise: a first plastic ring; a second plastic ring, the second plastic ring surrounding the first plastic ring, a center of the second plastic ring offset from a center of the first plastic ring; and a third plastic ring, the third plastic ring surrounding the first plastic ring and the second plastic ring, a center of the third plastic ring offset from the center of the first plastic ring and the center of the second plastic ring.

11. The system of claim 10, comprising multiple openings in the first plastic ring.

12. The system of claim 1, wherein the metal foil comprises multiple rings.

* * * * *